US007332698B2

(12) United States Patent
Cho et al.

(10) Patent No.: US 7,332,698 B2
(45) Date of Patent: Feb. 19, 2008

(54) MICROWAVE OVEN

(75) Inventors: Sung-wook Cho, Seoul (KR); Kwang-il Yang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 194 days.

(21) Appl. No.: 11/190,923

(22) Filed: Jul. 28, 2005

(65) Prior Publication Data

US 2006/0027572 A1 Feb. 9, 2006

(30) Foreign Application Priority Data

Aug. 4, 2004 (KR) ..... 10-2004-0061350

(51) Int. Cl.
*H05B 6/80* (2006.01)

(52) U.S. Cl. ..... 219/757; 126/299 R; 312/296

(58) Field of Classification Search ..... 219/757, 219/686, 702, 710, 716, 718, 758, 681, 756, 219/691, 695, 746, 748, 683, 400; 126/273 A, 126/21 A, 299 D, 299 R, 275 E, 237 R, 126/273 R, 229 R, 110 R, 39 R; 312/296
See application file for complete search history.

(56) References Cited

U.S. PATENT DOCUMENTS

| | | | | |
|---|---|---|---|---|
| 6,621,057 | B2 | 9/2003 | Kim | |
| 2002/0084268 | A1* | 7/2002 | Kim | 219/757 |
| 2003/0058304 | A1 | 3/2003 | Chen et al. | |
| 2003/0218011 | A1 | 11/2003 | Jeong | |
| 2003/0230571 | A1 | 12/2003 | Jeong et al. | |
| 2005/0011888 | A1* | 1/2005 | Kim | 219/757 |
| 2005/0121445 | A1* | 6/2005 | Kang | 219/757 |

FOREIGN PATENT DOCUMENTS

| | | |
|---|---|---|
| EP | 1 220 573 | 7/2002 |
| EP | 1 220 575 | 7/2002 |
| JP | 2002-198130 | 7/2002 |
| JP | 2003-343855 | 12/2003 |
| JP | 2004-82290 | 3/2004 |
| KR | 1998-067462 | 12/1998 |

(Continued)

OTHER PUBLICATIONS

Korean Notice of Official Action dated Feb. 27, 2006 for Korean App. No. 10-2004-0061350.

(Continued)

*Primary Examiner*—Quang Van
(74) *Attorney, Agent, or Firm*—Staas & Halsey LLP

(57) ABSTRACT

A microwave oven including a component compartment and a cooking compartment each including a discharging part to discharge air in the cooking compartment through the cooking compartment through portion; a supplying fan introducing the air to the component compartment through portion to cool the component compartment; a discharging fan introducing the air in the cooking compartment to the discharging part through the cooking compartment through portion; a fan motor between the supplying fan and the discharging fan to operate the supplying fan and the discharging fan; and an interfering part to interfere with the fan assembly when at least one of the supplying fan and the discharging fan is not in a predetermined position corresponding to the component compartment through portion and the discharging part.

14 Claims, 5 Drawing Sheets

FOREIGN PATENT DOCUMENTS

| | | |
|---|---|---|
| KR | 1999-005911 | 2/1999 |
| KR | 100265401 | 5/1999 |
| KR | 1020030049322 | 6/2003 |
| KR | 10-2004-0047077 | 6/2004 |
| KR | 1020040047077 | 6/2004 |

OTHER PUBLICATIONS

European Search Report dated Jan. 16, 2006 for European App. No. 05107219.7.

Japanese Patent Office Action, mailed May 22, 2007 and issued in corresponding Japanese Patent Application No. 2005-225819.

* cited by examiner

MICROWAVE OVEN

CROSS-REFERENCE TO RELATED APPLICATION

This application claims the benefit of Korean Patent Application No. 2004-0061350, filed on Aug. 4, 2004, in the Korean Intellectual Property Office, the disclosure of which is incorporated herein by reference.

BACKGROUND OF THE INVENTION

1. Field of the Invention

The present invention relates to a microwave oven, and more particularly, to a microwave oven comprising an improved mounting configuration for a fan assembly.

2. Description of the Related Art

Generally, a microwave oven comprises a main body casing formed with a cooking compartment to cook food and a component compartment in which different components are mounted to supply microwaves into the cooking compartment; a door to open and close the cooking compartment; and an operating panel provided in front of the component compartment. Further, the microwave oven usually comprises a fan to discharge air including a smell of the food from the cooking compartment, and to discharge and supply air from\to the microwave oven.

The conventional microwave oven, such as a wall tapestry type microwave oven disclosed in Korean Publication No. 10-2004-0047077, may comprise a discharging fan assembly including a discharging fan and a fan motor of large capacity to enhance blowing efficiency. Further, the discharging fan assembly may rotate so that a discharging hole may be provided to point in various directions. Accordingly, a discharging direction may be varied according to shapes of an external duct provided outside a main body of the microwave oven.

In the case of the conventional microwave oven, a user may rotate the discharging fan assembly to correspond to the shape of the external duct to install the discharging fan assembly. However, when the discharging fan assembly is not in a predetermined position to correspond to the external duct, a separated device to correct the position is not provided therein.

The discharging fan assembly in the conventional microwave oven is only employed for discharging the indoor air. This is inefficient because the discharging fan assembly does not introduce the air into the component compartment to cool the components, thus a separate source of cooling air must be used.

SUMMARY OF THE INVENTION

Accordingly, it is an aspect of the present invention to provide a microwave oven which cools a component compartment and at the same time discharges air from a cooking compartment.

Additional aspects and/or advantages of the invention will be set forth in part in the description which follows and, in part, will be apparent from the description, or may be learned by practice of the invention.

The foregoing and/or other aspects of the present invention are achieved by providing a microwave oven comprising: a main body casing comprising a component compartment and a cooking compartment, and including a component compartment through portion communicating with the component compartment; a cooking compartment through portion communicating with the cooking compartment; and a discharging part to discharge air in the cooking compartment through the cooking compartment through portion; a fan assembly provided in the main body casing, comprising a supplying fan introducing air to the component compartment through portion to cool the component compartment; a discharging fan introducing the air in the cooking compartment to the discharging part through the cooking compartment through portion; and a fan motor between the supplying fan and the discharging fan to operate the supplying fan and the discharging fan; and an interfering part provided in the main body casing to interfere with the fan assembly when at least one of the supplying fan and the discharging fan is not in a predetermined position corresponding to the component compartment through portion and the discharging part.

According to an aspect of the present invention, the interfering part protrudes from a portion of the main body casing adjacent to the fan assembly.

According to another aspect of the present invention, the interfering part comprises a notching part protruding in a transverse direction with respect to a coupling direction of the fan assembly at an end thereof.

According to still another aspect of the present invention, the supplying fan comprises a supplying blade rotated by the fan motor, and a supplying fan cover provided outside the supplying blade and including a supplying part allowing the air blown by the supplying blade to be directed toward the component compartment through portion, wherein the supplying fan cover interferes with the interfering part when the supplying part is not in a predetermined position.

According to an aspect of the present invention, the discharging fan comprises a discharging blade rotated by the fan motor, and a discharging fan cover provided outside the discharging blade and including a fan discharging part allowing the air from the cooking compartment through portion to be directed toward the fan discharging part.

According to an aspect of the present invention, the microwave oven further comprises a plurality of the discharging parts, wherein the discharging fan cover is detachably and rotatably coupled to the fan motor to allow the fan discharging part to correspond to one of the plurality of the discharging parts.

According to an aspect of the present invention, the component compartment through portion and the cooking compartment through portion are respectively provided at upper portions of the component compartment and the cooking compartment, and the microwave oven further comprises a partitioning wall provided between the component compartment through portion and the cooking compartment through portion to prevent the air discharged from the cooking compartment through portion from being introduced to the cooking compartment through portion.

According to an aspect of the present invention, a portion of the main body casing between the cooking compartment and the component compartment is formed with a through hole to supply the air from the component compartment into the cooking compartment.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENT

Figure 1:
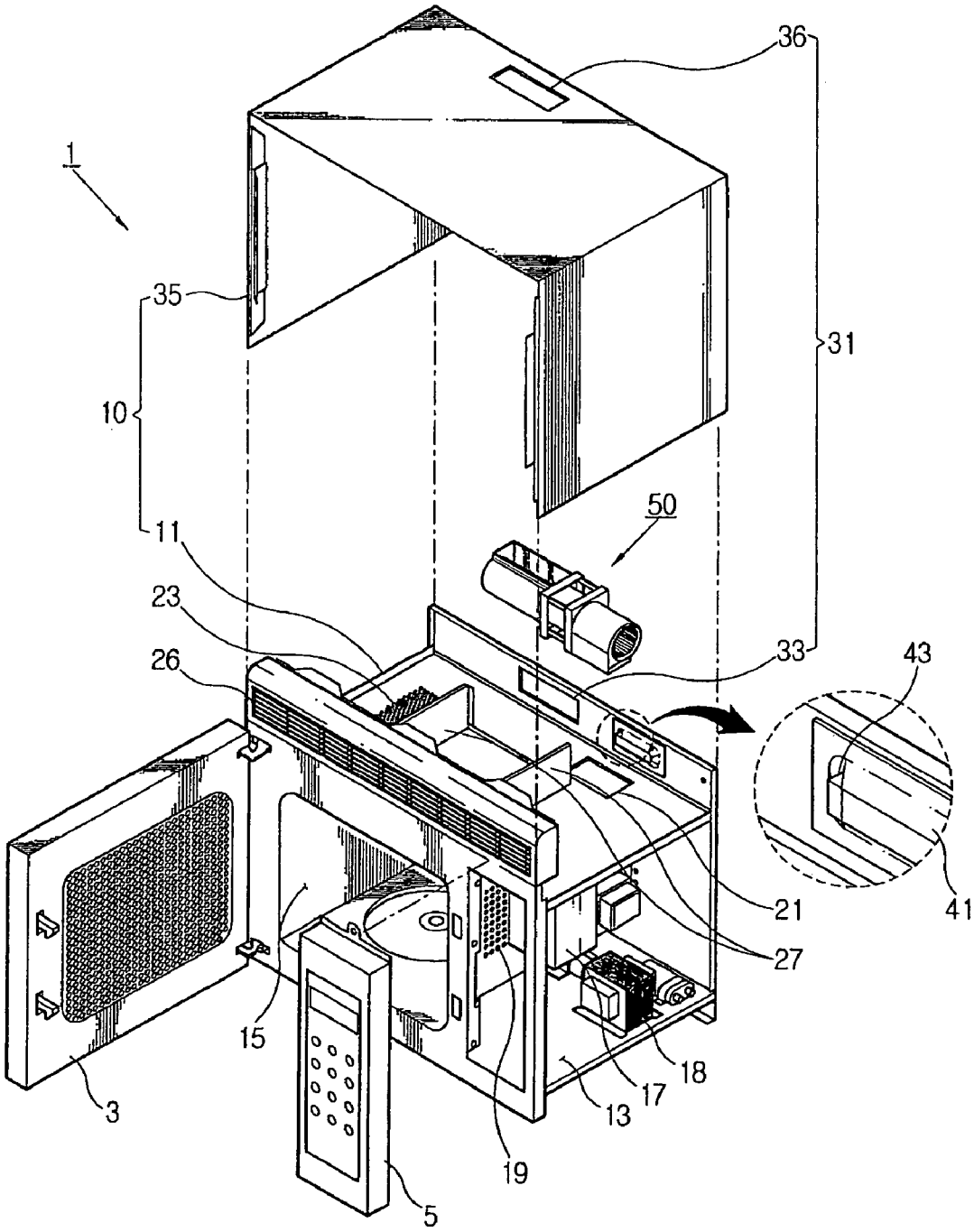
FIG. 1 is an exploded perspective view of a microwave oven according to an embodiment of the present invention.

Reference will now be made in detail to the embodiment of the present invention, an example of which is illustrated in the accompanying drawings, wherein like reference numerals refer to the like elements throughout. The embodiment is described below to explain the present invention by referring to the figures.

As shown in FIGS. 1 through 4, a microwave oven 1 according to the embodiment of the present invention comprises a main body casing 10 formed with a cooking compartment 15 to cook food and a component compartment 13 including various components to supply microwaves into the cooking compartment 15; a door 3 rotatably coupled to the main body casing 10 to open and close the cooking compartment 15; a control panel 5 provided in front of the component compartment 13 to control the various components; and a fan assembly 50 mounted in the main body casing 10 to cool the component compartment 13 and discharge air from the cooking compartment 15.

The main body casing 10 comprises a component compartment through portion 21 communicating with the component compartment 13; a cooking compartment through portion 23 communicating with the cooking compartment 15; and a discharging part 31 to discharge the air in the cooking compartment 15 through the cooking compartment through portion 23. The main body casing 10 further comprises a main body frame 11 formed with the cooking compartment 15 and the component compartment 13 and including the component compartment through portion 21 and the cooking compartment through portion 23, and a main body cover 35 to cover a left portion, a right portion, and an upper portion of the main body frame 11. An interfering part 41 is provided at the main body casing 10 to interfere with the fan assembly 50 when the fan assembly 50 is not in a predetermined position.

The main body frame 11 may comprise metal with good heat resistance but may also comprise plastics with good heat resistance. At the main body frame 11 between the cooking compartment 15 and the component compartment 13 are provided a plurality of through holes 19 to supply the air, which was introduced into the component compartment 13, into the cooking compartment 15.

The cooking compartment 15 is formed with a space to accommodate the food, etc. and the cooking compartment through portion 23 to discharge the air including food smell, etc. at an upper portion thereof.

The component compartment 13 is formed with an accommodating space to accommodate the components such as a magnetron 17 to supply the microwaves into the cooking compartment and a high voltage transformer 18. The components such as the magnetron 17 and the high voltage transformer 18 in the component compartment 13 generates heat from a high voltage so that the component compartment through portion 21 providing external air is provided to cool the components at an upper portion of the component compartment 13.

The component compartment through portion 21 and the cooking compartment through portion 23 are provided at an upper portion of the main body frame 11. Between the component compartment through portion 21 and the cooking compartment through portion 23 is provided a partitioning wall 27 to prevent the air discharged through the cooking compartment through portion 23 from being introduced into the component compartment through portion 21.

The partitioning wall 27 is inserted between the main body frame 11 and the main body cover 35. The partitioning wall 27 introduces the air, which was discharged from the cooking compartment through portion 23, to be discharged through the discharging part 31 by a discharging fan 61 of the fan assembly 50 to be described later. The partitioning wall 27 is between the main body frame 11 and the main body cover 35, and includes a pair of partitioning walls. Between the pair of partitioning walls is mounted a lamp (not shown) to illuminate the cooking compartment 15. At an upper portion of the main body frame 11 a light through hole (not shown) is provided to correspond to the lamp so that light from the lamp may shine on the cooking compartment 15. In front of the partitioning wall 27 is mounted a grill 26 formed with an air inlet to supply air, which is inside a room in which the microwave oven 1 is located. With this configuration, the discharging fan 61 of the fan assembly 50 to be described later discharges at the same time the air from the cooking compartment through portion 23 and the indoor air from the grill 26, after the partitioning wall 27 introduces the air and the indoor air.

The discharging part 31 passes through the main body casing 10 to discharge the air from the cooking compartment through portion 23 and the indoor air from the grill 26. The discharging part 31 may be connected to an external duct (not shown) extending to an outside of the building to discharge the air in the cooking compartment 15 and the indoor air. The discharging part 31 may be plurally provided to correspond to the shape of the external duct of the building in which the microwave oven 1 is mounted. The external duct of the building may be provided above the microwave oven 1 or at rear of the microwave oven 1. By way of example, the discharging part 31 includes portions (discussed below) which are provided at an upper portion and a rear portion of the main body casing 10 so that the external duct may be positioned at an upper portion and a rear portion of the microwave oven 1. Specifically, the discharging part 31 comprises a first discharging part 33 provided at an upper and rear portion of the main body frame 11, and a second discharging part 36 provided at a rear portion of the main body cover 35. However, the discharging parts 31 may also be located at a left portion, a right portion, a front portion, and/or a lower portion of the main body casing 10. A user may connect any one of the plurality of discharging parts 31 to the external duct of the building.

The main body cover 35 is shaped like an inverted "U" on the outside of the main body frame 11. The main body cover 35 is coupled to the main body frame 11 by a screw, etc. An upper portion of the main body cover 35 is formed with the second discharging part 36.

Figure 2:
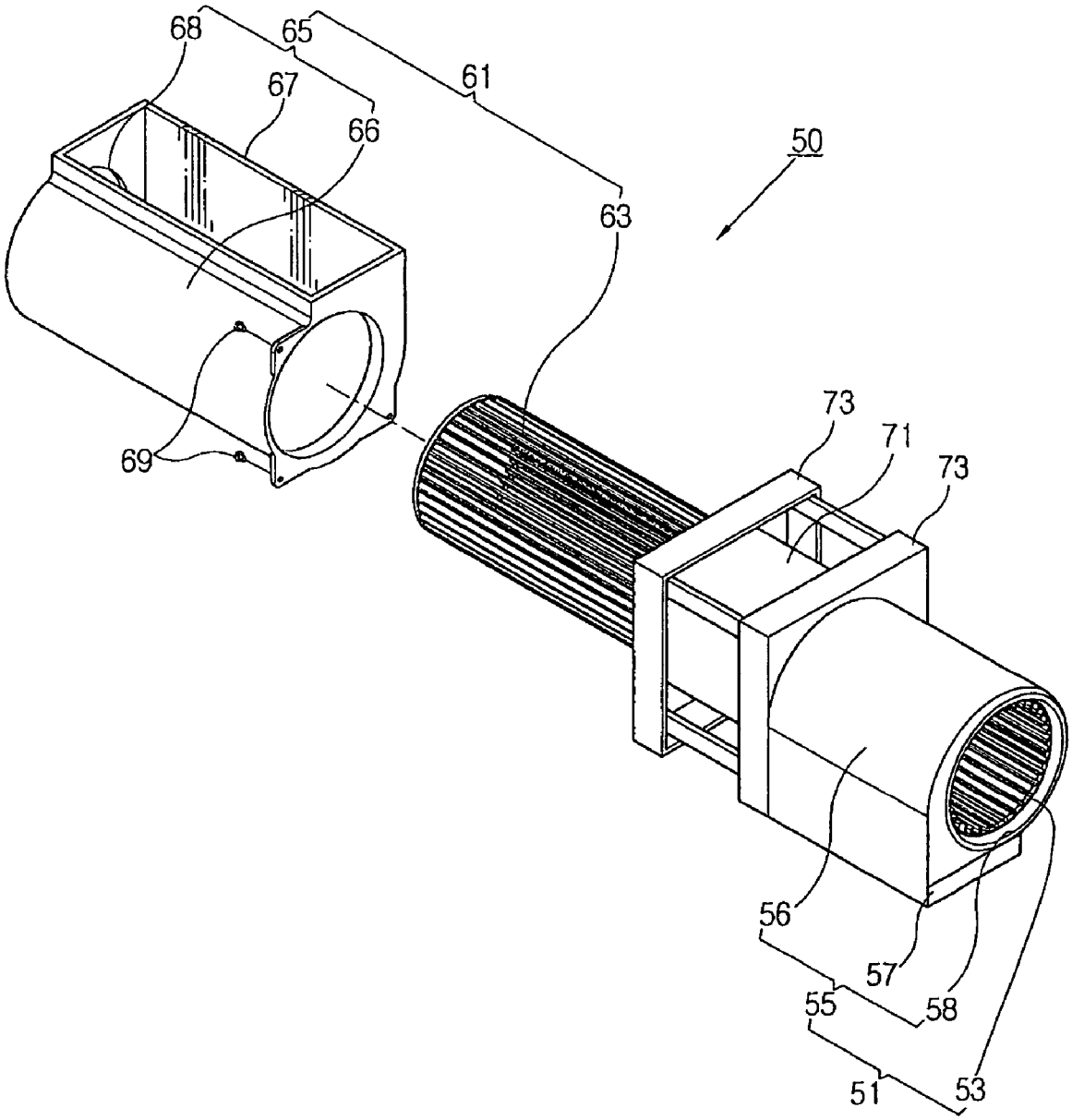
FIG. 2 is an exploded perspective view of a fan assembly of a microwave oven according to the embodiment of the present invention.

Referring to FIG. 2, the fan assembly 50 comprises a supplying fan 51 to supply the air into the component compartment through portion 21 to cool the component compartment 13; a discharging fan 61 to introduce the air in the cooking compartment 15 into the discharging part 31 through the cooking compartment through portion 23; and a fan motor 71 between the supplying fan 51 and the discharging fan 61 and operating the supplying fan 51 and the discharging fan 61. The fan assembly 50 is provided to correspond to the component compartment through portion 21 and the discharging part 31 at an upper and rear portion of the main body casing 10. The fan assembly 50 is provided between the main body frame 11 and the main body cover 35, and behind the partitioning wall 27. When at least one of the supplying fan 51 and the discharging fan 61 is not in a predetermined position to correspond to the component compartment through portion 21 and the discharging part 31, the fan assembly 50 is interfered with the interfering part 41 and therefore cannot be mounted in the main body casing 10.

The supplying fan 51 comprises a supplying blade 53 rotating by the fan motor 71, and a supplying fan cover 55 provided at an outside of the supplying blade 53 and allowing the air blown from the supplying blade 53 to be directed toward the component compartment through portion 21. The supplying fan 51 corresponds to the component compartment through portion 21 and a first side of the fan motor 71.

There is a plurality of the supplying blades 53 which are rotated by the fan motor 71, and the plurality of the supplying blades 53 are arranged along a cylindrical circumference centering around a rotation axis of the fan motor 71.

The supplying fan cover 55 comprises a cylindrical supplying cover main body 56 to accommodate the supplying blades 53; a supplying part 57 passing through the supplying cover main body 56 to discharge the blowing air generated by rotation of the supplying blades 53; and a supplying cover through portion 58 provided at an opposite side of the coupling portion with the fan motor 71 to inhale circumferential air thereof. The supplying fan cover 55 may be interfered with the interfering part 41 when the supplying part 57 is not in a predetermined position with respect to the component compartment through portion 21. The supplying fan cover 55 may be integrally provided with a fan motor supporter 73, to be described later. However, the supplying fan cover 55 may be detachably coupled to the fan motor supporter 73 by a screw, etc.

The diameter of the supplying cover main body 56 is larger along a rotating direction of the supplying blades 53 to discharge the blowing air generated by rotation of the supplying blades 53 to the supplying part 57. Accordingly, when the supplying part 57 is mounted toward the component compartment through portion 21, the supplying cover main body 56 may be not interfered with the interfering part 41. Also, when the user tries to mount the supplying part 57 in other directions with respect to the component compartment through portion 21, the supplying cover main body 56 is not allowed to be mounted thereon due to inference by the interfering part 41.

The supplying part 57 protrudes from the supplying cover main body 56 to correspond to the component compartment through portion 21.

The discharging fan 61 comprises a discharging blade 63 rotating by the fan motor 71, and a discharging fan cover 65 provided outside the discharging blade 63 and allowing the air blown from the discharging blade 63 to be directed toward the discharging part 31. The discharging fan 61 is provided to correspond to at least one of the first discharging part 33 and the second discharging part 36 at a second side of the fan motor 71.

A plurality of the discharging blades 63 is provided and rotate by the fan motor 71, and the plurality of the discharging blades 63 are arranged along a cylindrical circumference centering around a rotating axis of the fan motor 71.

The discharging fan cover 65 comprises a cylindrical discharging cover main body 66 to accommodate the discharging blades 63; a fan discharging part 67 passing through the discharging cover main body 66 to discharge the blowing air generated from rotation of the discharging blades 63; and a supplying cover through portion 68 provided at an opposite side of the main body 66 from the fan motor 71 to supply the air and the indoor air from the cooking compartment through portion 23 and the grill 26. The discharging fan cover 65 may be detachably and rotatably coupled to the fan motor 71 so that the fan discharging part 67 is provided toward one of the plurality of discharging parts 31. The discharging fan cover 65 is detachably coupled to the fan motor supporter 73 by a screw 69, etc. When the discharging fan cover 65 is separated from the fan motor 71, the discharging fan cover 65 may be coupled thereto by the screw 69 after the fan discharging part 67 rotates toward one of the first discharging part 33 and the second discharging part 36. Accordingly, the user rotates the discharging fan cover 65 so that the fan discharging part 67 is provided toward the fan discharging part 61 to correspond to the external duct, and then the discharging fan 67 may be easily assembled.

The diameter of the discharging cover main body 66 is larger along a rotating direction of the discharging blades 63 to discharge the blowing air generated by rotation of the discharging blades 63 to the fan discharging part 67, a process, which is similar to that of the supplying cover main body 56. The fan discharging part 67 protrudes from the discharging cover main body 66 to correspond to the discharging part 31.

The fan motor 71 is provided between the supplying fan 51 and the discharging fan 61 and rotates the supplying blades 53 and the discharging blades 63. The fan motor 71 is supported by fan motor supporters 73 provided on opposite sides thereof, and is coupled to the supplying fan 51 and the discharging fan 61.

The interfering part 41 is provided in the main body casing 10 to interfere with the fan assembly 50 when at least one of the supplying fan 51 and the discharging fan 61 is not in the predetermined position to correspond to the component compartment through portion 21 and the discharging part 31. The interfering part 41 may protrude from the main body casing 10 adjacent to the fan assembly 50. The interfering part 41 does not interfere with the supplying fan cover 55 when the supplying part 57 is mounted toward the component compartment through portion 21, and the interfering part 41 interferes with the supplying fan cover 55 when the supplying part 57 is mounted in other directions with respect to the component compartment through portion 21. The interfering part 41 may protrude frontward from the main body frame 11 provided behind the fan assembly 50. However, the interfering part 41 may be bent frontward from the main body frame 11 provided in the rear of the fan assembly 50.

An end of the interfering part 41 may comprise a notching part 43 protruded in a horizontal direction with respect to a mounting direction of the fan assembly 50.

The notching part 43 perpendicularly protrudes from a front end of the interfering part 41 with respect to the coupling direction of the fan assembly 50 to prevent the fan assembly 50 from being forcibly assembled by the user when the fan assembly 50 is interfered with because the fan assembly 50 is not in the predetermined position.

Figure 3:
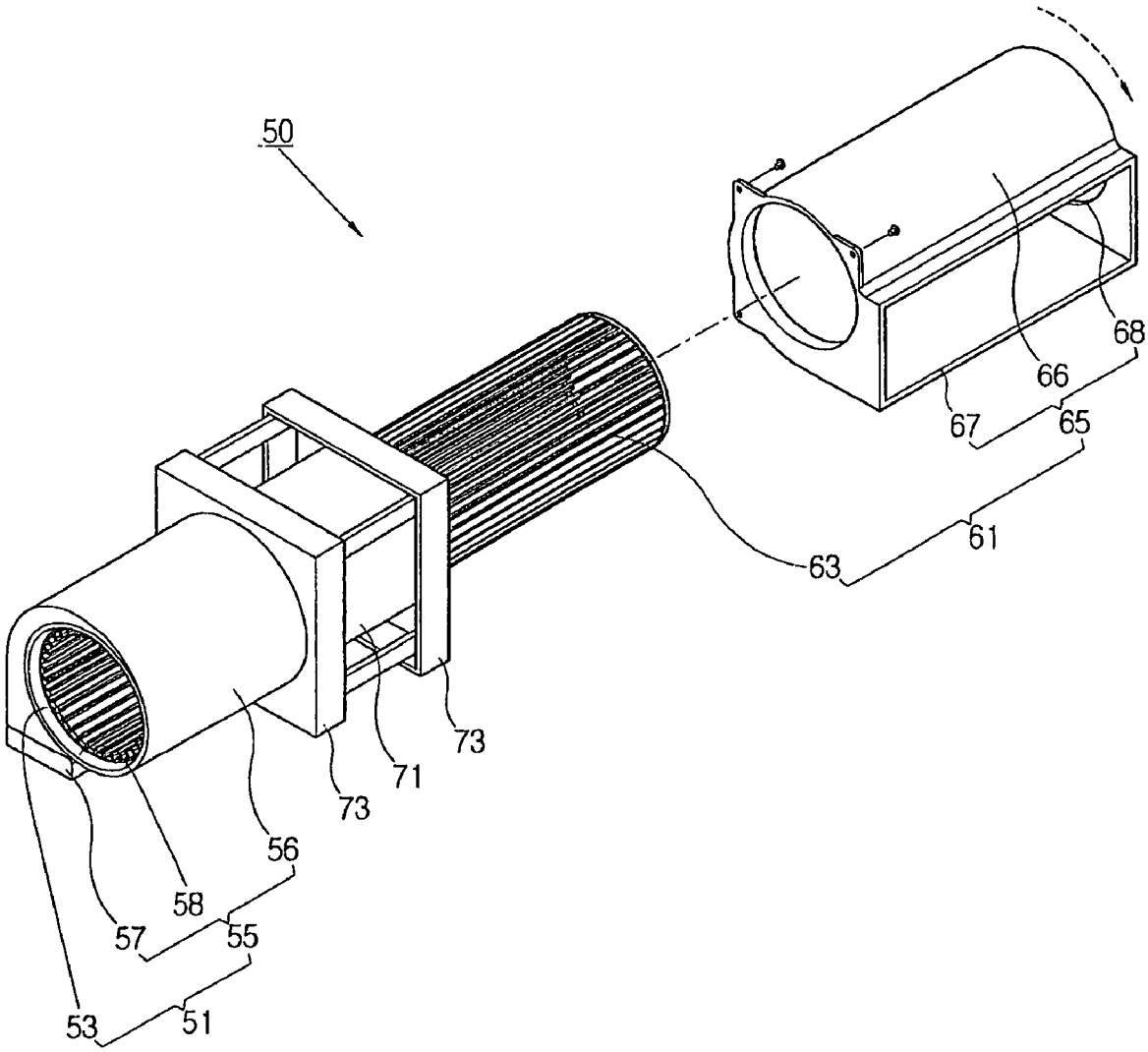
FIG. 3 is a perspective view illustrating a rotated discharging fan cover provided in a fan assembly of the microwave oven of FIG. 2.
Figure 4:
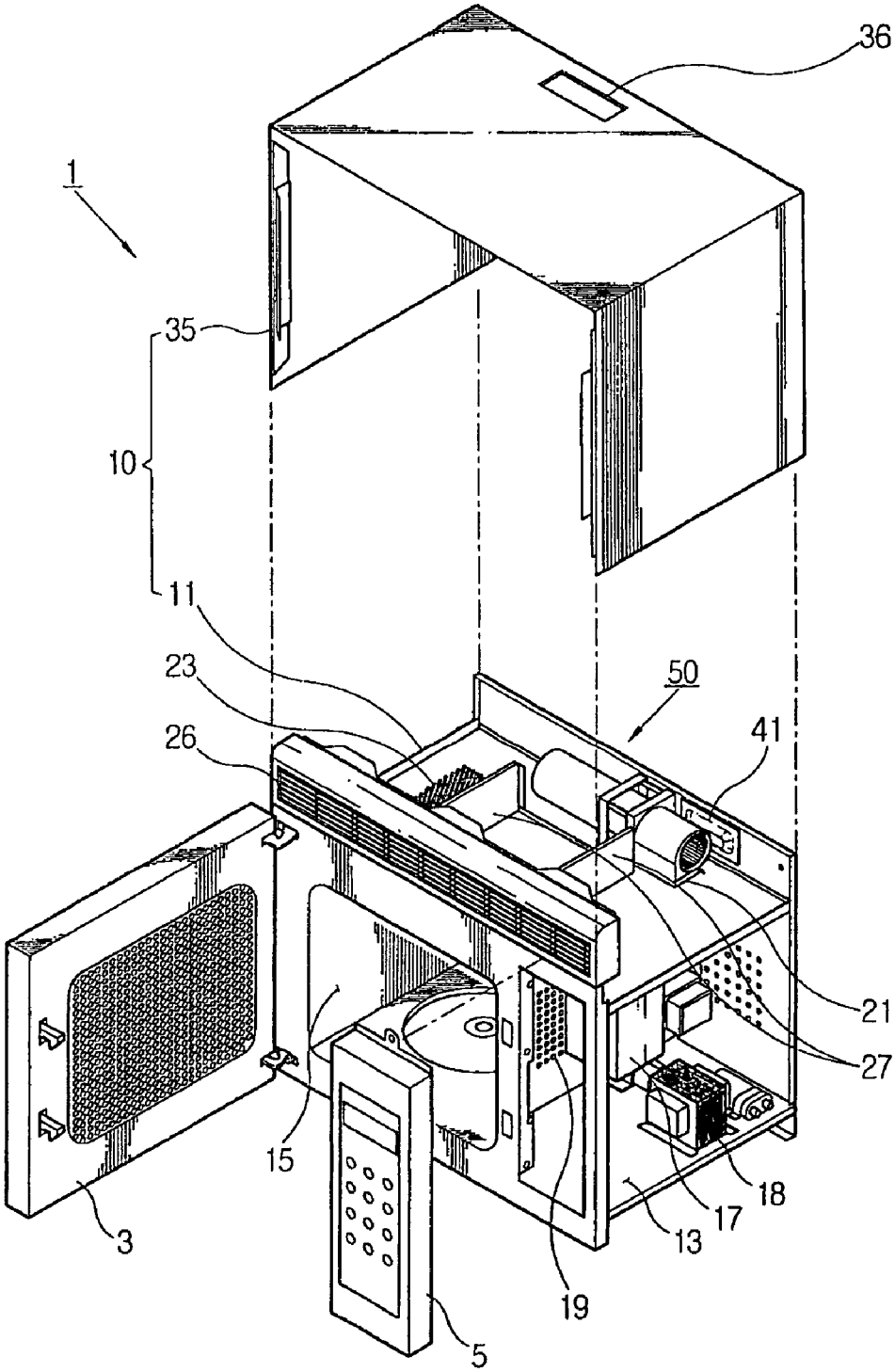
FIG. 4 is a perspective view illustrating a fan assembly of FIG. 3 mounted in a microwave oven according to the embodiment of the present invention.

With this configuration, a process for assembling the fan assembly on the main body casing of the microwave oven according to the present invention on the main body casing will be described with reference to FIGS. 3 and 4.

First, the user chooses the discharging part 31 to correspond to the external duct (not shown) and, the user rotates the discharging fan cover 65 of the fan assembly 50 to correspond to the chosen discharging part 31. Then, the user mounts the fan assembly 50 at an upper portion of the main body frame 11 to correspond to the component compartment through portion 21 and the chosen discharging part 31. When the fan assembly 50 is positioned in the predetermined position to correspond to the component compartment through portion 21 and the chosen discharging part 31, the fan assembly 50 is not interfered with the interfering part 41 and is mounted on the main body casing 10. However, when the fan assembly 50 is not in the predetermined position to correspond to the component compartment through portion 21 and the chosen discharging part 31, the fan assembly 50 is interfered with the interfering part 41 and is not mounted thereon. The fan assembly 50 may be coupled to the main body casing 10 by the screw, etc.

Figure 5:
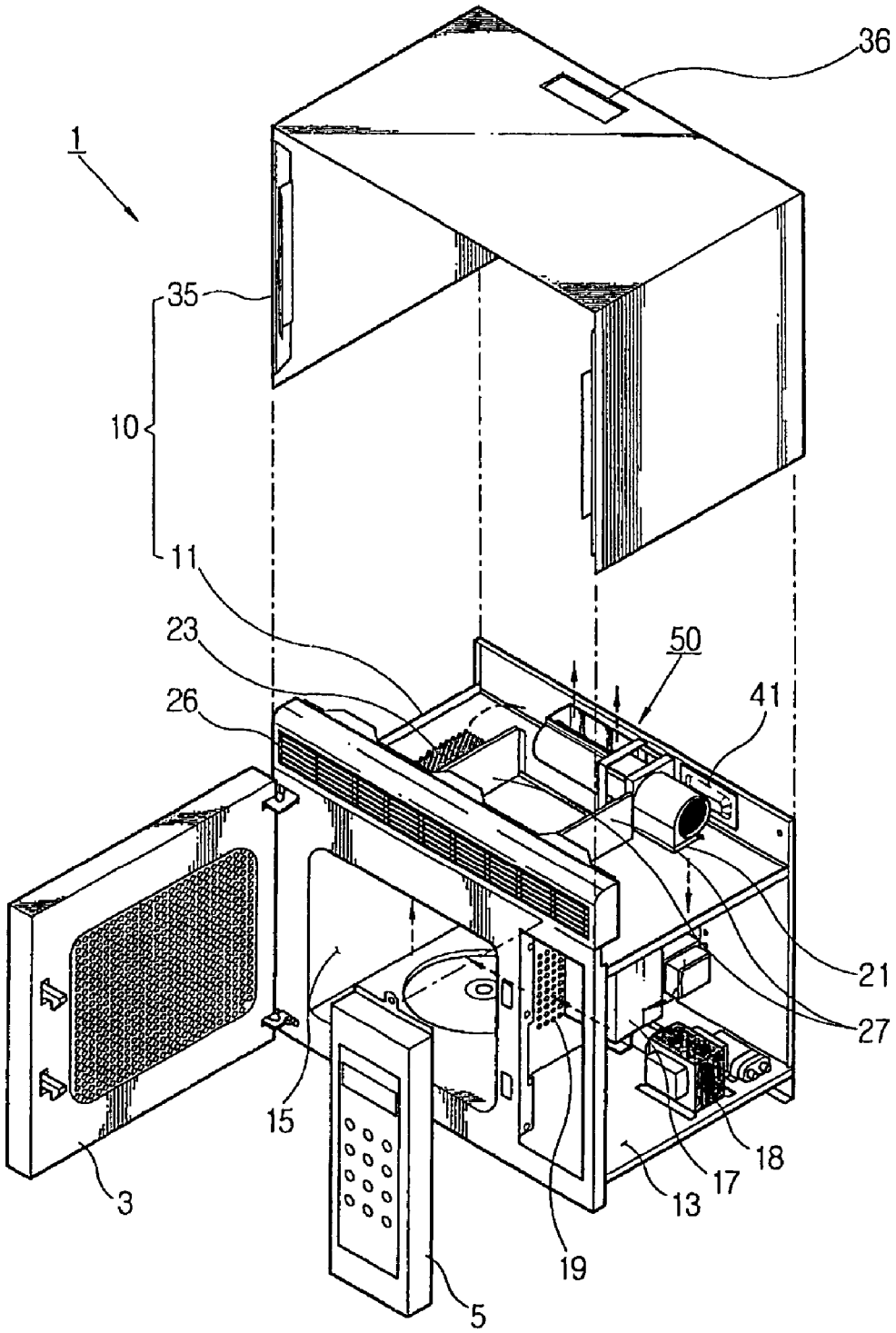
FIG. 5 is a perspective view schematically illustrating an air circulation process of a microwave oven according to the embodiment of the present invention.

As shown in FIG. 5, an air circulation process of the microwave oven 1 according to the embodiment present invention will be described as follows.

First, when the fan assembly 50 is operated, the supplying fan 51 introduces the air into the component compartment 13 through the component compartment through portion 21. Then, the component compartment 13 is cooled by the introduced air, and the air which cooled the component compartment 13 is supplied into the cooking compartment 15 through the through hole 19. The air in the cooking compartment 15 is then discharged into the discharging part 31 through the cooking compartment through portion 23 by the discharging fan 61 and then the discharging fan 61 may discharge the indoor air from the grill 26 at the same time.

Accordingly, the microwave oven according to the embodiment of the present invention comprises the interfering part 41 to prevent the fan assembly 50 from being improperly installed. Further, the microwave oven comprises the notching part to prevent forcible installation of the fan assembly. The fan assembly may cool the component compartment and at the same time discharge the air in the cooking compartment, and also discharge the indoor air from the grill.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven comprising:

a main body casing comprising:

a component compartment, a cooking compartment, a component compartment through portion communicating with the component compartment, a cooking compartment through portion communicating with the cooking compartment, and a discharging part to discharge air in the cooking compartment through the cooking compartment through portion;

a fan assembly provided in the main body casing, comprising:

a supplying fan introducing cooling air to the component compartment through portion to cool the component compartment, a discharging fan introducing the air in the cooking compartment to the discharging part through the cooking compartment through portion, and a fan motor between the supplying fan and the discharging fan to operate the supplying fan and the discharging fan; and an interfering part provided in the main body casing to interfere with the fan assembly when at least one of the supplying fan and the discharging fan is not in a predetermined position corresponding to the component compartment through portion and the discharging part, wherein the interfering part protrudes from a portion of the main body casing closest to the fan assembly.

2. The microwave oven according to claim 1, wherein the interfering part comprises a notching part at an end thereof and protruding in a transverse direction with respect to a coupling direction of the fan assembly.

3. The microwave oven according to claim 1, wherein the supplying fan comprises;

a supplying blade rotated by the fan motor to thereby blow the cooling air, and a supplying fan cover provided outside the supplying blade and including a supplying part allowing the cooling air blown by the supplying blade to be directed toward the component compartment through portion, wherein the supplying fan cover interferes with the interfering part when the supplying part is not in a predetermined position.

4. The microwave oven according to claim 1, wherein the discharging fan comprises a discharging blade rotated by the fan motor, and a discharging fan cover provided outside the discharging blade and including a fan discharging part allowing the air in the cooking compartment through portion to be directed toward the discharging part.

5. The microwave oven according to claim 4, further comprising a plurality of the discharging parts, wherein the discharging fan cover is detachably and rotatably coupled to the fan motor to allow the fan discharging part to correspond to one of the plurality of the discharging parts.

6. The microwave oven according to claim 1, wherein the component compartment through portion and the cooking compartment through portion are respectively provided at upper portions of the component compartment and the cooking compartment, and the microwave oven further comprises a partitioning wall provided between the component compartment through portion and the cooking compartment through portion to prevent the air discharged from the cooking compartment through portion from being introduced into the cooking compartment through portion.

7. The microwave oven according to claim 1, further comprising a through hole between the cooking compartment and the component compartment, the through hole to supply the cooling air from the component compartment into the cooking compartment.

8. A microwave oven comprising:

a cooking compartment;

a component compartment;

a main body casing defining the cooking compartment and the component compartment;

a first fan to cool the component compartment;

a second fan to discharge air from the cooking compartment;

a motor to operate the first and second fans; and an interfering part provided in the main body casing to interfere with the first and second fans when at least one of the first fan and the second fan is not in a predetermined position, wherein the interfering part protrudes from a portion of the main body casing closest to the first and second fans.

9. The microwave oven according to claim 8, wherein the motor simultaneously operates the first and second fans.

10. A microwave oven comprising:

a main body casing defining a plurality of compartments; and a fan assembly to provide air to or discharge air from at least one of the compartments, the main body casing comprising an interfering part to interfere with the fan assembly when the fan assembly is not properly positioned to provide or discharge the air;

wherein the interfering part protrudes from a portion of the main body casing closest to the fan assembly.

11. The microwave oven according to claim 10, further comprising a partition wall, the fan assembly being between the main body casing and the partition wall, wherein the fan assembly has a variable outer diameter so that the fan assembly cannot fit between the main body casing and the partition wall when the fan assembly is not properly positioned.

12. The microwave oven according to claim 10, wherein the main body casing further comprises a main body frame forming an outer portion of the microwave oven, and the interfering part is a protrusion protruding from an inner portion of the main body frame.

13. A microwave oven comprising:

a main body casing defining a plurality of compartments; and a fan assembly to provide air to or discharge air from at least one of the compartments, the main body casing comprising an interfering part to interfere with the fan assembly when the fan assembly is not properly positioned to provide or discharge the air, wherein the main body casing further comprises a main body frame forming an outer portion of the microwave oven, and the interfering part is a bent portion at an inner portion of the main body frame.

14. A method of displacing air in a microwave oven, comprising:

providing a main body casing defining a first compartment and a second compartment;

driving a first fan with a motor to thereby cool the first compartment of the microwave oven;

driving a second fan with the motor to thereby discharge air from the second compartment of the microwave oven;

providing an interfering part in the main body casing to interfere with the first and second fans when at least one of the first fan and the second fan is not in a predetermined position, wherein the interfering cart protrudes from a portion of the main body casing closest to the first and second fans.

* * * * *

UNITED STATES PATENT AND TRADEMARK OFFICE

CERTIFICATE OF CORRECTION

PATENT NO. : 7,332,698 B2
APPLICATION NO. : 11/190923
DATED : February 19, 2008
INVENTOR(S) : Sung-wook Cho et al.

It is certified that error appears in the above-identified patent and that said Letters Patent is hereby corrected as shown below:

Column 10, Line 28, change “cart” to --part--.

Signed and Sealed this

Twenty-second Day of July, 2008

JON W. DUDAS
*Director of the United States Patent and Trademark Office*